US007608166B2

(12) United States Patent
Huang et al.

(10) Patent No.: US 7,608,166 B2
(45) Date of Patent: Oct. 27, 2009

(54) PAPERS HAVING BORATE-BASED COMPLEXING AND METHOD OF MAKING SAME

(75) Inventors: Yan C. Huang, Campbell Hall, NY (US); Kapil M. Singh, Monroe, NY (US); Yaoliang Hong, Oakland, NJ (US); M. Bruce Lyne, Stockholm (SE)

(73) Assignee: International Paper Company, Memphis, TN (US)

( * ) Notice: Subject to any disclaimer, the term of this patent is extended or adjusted under 35 U.S.C. 154(b) by 164 days.

(21) Appl. No.: 10/667,238

(22) Filed: Sep. 17, 2003

(65) Prior Publication Data

US 2005/0056391 A1 Mar. 17, 2005

(51) Int. Cl.

| | |
|---|---|
| ***D21H 21/16*** | (2006.01) |
| ***D21H 21/18*** | (2006.01) |
| ***D21H 19/00*** | (2006.01) |
| ***D21H 27/00*** | (2006.01) |
| ***D21H 17/12*** | (2006.01) |
| ***D21H 17/28*** | (2006.01) |

(52) U.S. Cl. ..... 162/135; 162/158; 162/175; 162/181.1; 162/181.5; 162/204

(58) Field of Classification Search ..... 162/135, 162/158–159, 175, 181.1–181.5, 204–205, 162/183–185; 428/195.1, 357, 395.1
See application file for complete search history.

(56) References Cited

U.S. PATENT DOCUMENTS

| | | | | | |
|---|---|---|---|---|---|
| 1,813,367 | A | * | 7/1931 | Thompson | 169/46 |
| 1,839,136 | A | * | 12/1931 | Somoza Vivas | 162/159 |
| 1,998,758 | A | * | 4/1935 | Holt et al. | 162/10 |
| 2,399,489 | A | * | 4/1946 | Landes | 524/47 |
| 2,497,469 | A | * | 2/1950 | Robie | 51/301 |
| 2,698,793 | A | * | 1/1955 | Landes et al. | 162/164.3 |
| 2,772,966 | A | * | 12/1956 | Daniel, Jr. et al. | 162/180 |
| 2,772,969 | A | * | 12/1956 | Lundberg et al. | 162/179 |
| 2,875,044 | A | * | 2/1959 | Dunn et al. | 162/135 |
| 3,062,703 | A | * | 11/1962 | Hofrciter et al. | 162/175 |
| 3,112,214 | A | * | 11/1963 | Roberts et al. | 427/301 |
| 3,245,870 | A | * | 4/1966 | Orth, Jr. et al. | 162/159 |
| 3,313,803 | A | * | 4/1967 | Roberts et al. | 536/111 |
| 3,438,808 | A | * | 4/1969 | Davidowich et al. | 428/511 |
| 3,475,190 | A | * | 10/1969 | Fischer et al. | 252/582 |
| 3,475,199 | A | * | 10/1969 | Wolf | 428/486 |
| 3,541,033 | A | * | 11/1970 | Buttrick et al. | 524/556 |
| 3,644,167 | A | * | 2/1972 | Mowry | 428/182 |
| 4,010,817 | A | * | 3/1977 | Warren et al. | 181/284 |
| 4,470,877 | A | * | 9/1984 | Johnstone et al. | 162/124 |
| 4,756,801 | A | * | 7/1988 | Jokinen et al. | 162/175 |
| 4,853,085 | A | * | 8/1989 | Johnstone et al. | 162/128 |
| 6,171,444 | B1 | * | 1/2001 | Nigam | 162/158 |
| 6,432,517 | B1 | * | 8/2002 | Yokota et al. | 428/32.21 |
| 2003/0118810 | A1 | * | 6/2003 | Grantham et al. | 428/323 |
| 2005/0056391 | A1 | * | 3/2005 | Huang et al. | 162/175 |
| 2005/0129861 | A1 | * | 6/2005 | Grantham et al. | 427/393 |
| 2005/0274472 | A1 | * | 12/2005 | Steif | 162/159 |
| 2008/0035292 | A1 | * | 2/2008 | Singh et al. | 162/175 |
| 2009/0133488 | A1 | * | 5/2009 | Singh et al. | 73/159 |

FOREIGN PATENT DOCUMENTS

| | | | | |
|---|---|---|---|---|
| EP | 0148647 | A | | 7/1985 |
| GB | 2 137 613 | A | | 10/1984 |
| JP | 06 047826 | A | | 2/1994 |
| JP | 2002 266285 | A | | 9/2002 |
| KR | 2001 056 213 | A | | 7/2001 |
| TW | 268 970 | A | | 1/1996 |
| WO | WO 2004/027149 | A1 | * | 4/2004 |
| WO | WO 2007/008786 | A1 | * | 1/2007 |
| WO | WO 2007/053681 | A1 | * | 5/2007 |
| WO | WO 2007/084571 | A2 | * | 7/2007 |

OTHER PUBLICATIONS

JPO, Machine translation of JP 06-047826.*
Database WPI, Section Ch, Week 200338, Derwent Publications Ltd., London, GB; Class A11, AN 2003-397136 XP002266048 & JP 2002 266285 A (Unichika Chem KK), Sep. 18, 2002 abstract.
Database WPI, Section Ch, Week 199615 Derwent Publications Ltd., London, GB; Class A81, An 1996-150171 XP002266049.
Database WPI, Section Ch, Week 199412, Derwent Publications Ltd., London, GB; Class A14, AN 1994-097406 XP002266050 & JP 06 047826 A (Kaihatsu Board KK), Feb. 22, 1994 abstract.
Database WPI, Section Ch, Week 200219, Derwent Publications Ltd., London, GB; Class A97, AN 2002-145939 XP002266051 & KR 2001 056 213 A (Korea Security Printing & Mining Corp), Jul. 4, 2001 abstract.

* cited by examiner

*Primary Examiner*—José A Fortuna
(74) *Attorney, Agent, or Firm*—Thomas W. Barnes, III; John K. Spike; Richard C. Stewart, II

(57) ABSTRACT

The present invention relates to paper substrates containing either an internal starch or a size press applied starch and a boron-containing compound and having improved physical and mechanical properties, as well as methods of making and using the same.

18 Claims, No Drawings

PAPERS HAVING BORATE-BASED COMPLEXING AND METHOD OF MAKING SAME

FIELD OF THE INVENTION

The invention relates to the field of paper and paperboard products and, in particular, to paper and paperboard products having improved dimensional stability properties. Another aspect of this invention relates a process of making the paper and paperboard products of this invention.

BACKGROUND OF THE INVENTION

A continuing problem in the papermaking arts is the tendency of papers to expand or contract in size based on ambient moisture conditions. In a high moisture environment, paper fibers will generally absorb moisture and expand. As the fibers expand, the dimensions of the overall paper also expand, a phenomena referred to as hygroexpansion. On the other hand, when papers are exposed to particularly dry ambient conditions, the paper fibers may give off previously retained moisture leading to fiber and paper shrinkage. Additionally, variations in humidity conditions may lead to other variations and instabilities in the dimensions of the paper including curling and cockling.

Moreover, exposure to high humidity levels may lead to reductions in the strength and stiffness properties of papers. This is particularly problematic in heavier paperboards that are used for packaging wherein maintenance of high strength and stiffness is essential.

Accordingly, there is a need for papers which are less sensitive to ambient conditions and which do not tend to expand or shrink due to local moisture conditions.

SUMMARY OF THE INVENTION

With regard to the foregoing and other objects and advantages, the present invention provides a method for forming a paper or paperboard. The method includes providing a papermaking furnish comprising cellulosic fibers, starch and a boron-containing compound. The amount of starch compound may vary widely as for example equal to or less than about 200 lbs per ton of fiber and is preferably equal to or less than about 170 lbs per ton of fiber, more preferably from about 2 lbs to about 150 lbs per ton of fiber and most preferably from about 2 lbs to about 100 lbs per ton of fiber with amount of more preferably from about 3 lbs to about 50 lbs of starch per ton of fiber in the embodiments of choice. The amount of boron containing compound may also vary widely. In the preferred embodiments the amount of boron containing compound will depend on the amount of starch. In these preferred embodiments, the compound is present in an amount equal to or less than about 7% of the weight of starch added to the furnish, preferably equal to or less than about 5% of the weight of starch added to the furnish, more preferably equal to or less than about 3% of the weight of starch added to the furnish and most, preferably from about 0.2% to about 2% of the weight of starch added to the furnish. In the embodiments of choice, the amount of starch is from about 0.7% to about 0.8% of the weight of starch added to the furnish. The method further includes forming a fibrous web from the papermaking furnish and drying the web. In the preferred embodiments of the invention, the dried web is calendered to provide a finished paper or paperboard.

In another aspect, the invention relates to a paper or paperboard formed by the method of this invention. The paper or paperboard comprises a paper web formed from a pulp furnish comprising cellulosic fibers, starch and a boron-containing compound. In one embodiment, the major portion (e.g. greater than 50%, preferably greater than 75% and more preferably greater than about 80% to about 90%) of the starch and a boron-containing compound is at or about the surfaces of the web. In another embodiment, the major portion (e.g. greater than 50%, preferably greater than 75% and more preferably greater than about 80% to about 90%) of the starch and a boron-containing compound is dispersed through out the web the web.

In forming the paper or paperboard, it is preferred that cooked starch and at least a portion of the boron-containing compound are premixed with one another to provide a slurry and the resultant slurry is then added to the pulp furnish. In certain embodiments, it is further preferred to mix the unconverted starch and at least a portion of the boron-containing compound are premixed with one another to provide a slurry and the resultant slurry is then cooked to convert the starch prior to adding the slurry to the pulp furnish. However, in certain other embodiments of the invention, it may be preferred that the boron-containing compound is added directly to the pulp furnish.

In still another aspect, the invention provides a method for forming a paper or paperboard including the steps of providing a papermaking furnish comprising cellulosic fibers, forming a fibrous web from the papermaking furnish, drying the web and sizing the web by applying a slurry to the web, the slurry comprises starch solids and a boron-containing compound. The amount of boron containing compound may also vary widely. In the preferred embodiments the amount of boron containing compound will depend on the amount of starch. In these preferred embodiments, the compound is present in an amount equal to or less than about 7% of the weight of starch added to the furnish, preferably equal to or less than about 5% of the weight of starch added to the furnish, more preferably equal to or less than about 3% of the weight of starch added to the furnish and most, preferably from about 0.2% to about 2% of the weight of starch added to the furnish. In the embodiments of choice, the amount of starch is from about 0.7% to about 0.8% of the weight of starch added to the furnish. In the preferred embodiments of the invention, the dried web is calendered to provide a finished paper or paperboard.

In yet another aspect, the invention relates to a paper or paperboard formed by the method of this invention The paper or paperboard comprises comprising a paper web formed from a pulp furnish including cellulosic fibers and having a sizing applied to the paper web, the sizing including starch solids and a boron-containing compound present in the amounts described above.

Illustrative of useful boron containing compounds are boric acid and metal borate salts. Preferred boron-containing compounds for the practice of the invention may be selected from the group consisting of boric acid, borax, and zinc borate.

The starch employed in the invention may be either an anionic starch, a cationic starch, or an amphipathic depending on the particular embodiment being practiced. Preferred starch sources may be selected from the group consisting of cornstarch, wheat starch, potato starch, rice starch, tapioca starch, and sago starch.

DETAILED DESCRIPTION OF THE INVENTION

The invention involves papers having either an internal starch or a size press applied starch and a boron-containing compound which is added in proportion to the starch and which is believed to interact with the starch to provide improved physical and mechanical properties in the paper. (As used herein, a paper refers to and includes both paper and paperboard unless otherwise noted.)

The paper is provided as a web containing cellulosic pulp fibers such as fiber derived from hardwood trees, softwood trees, or a combination of hardwood and softwood trees prepared for use in a papermaking furnish by any known suitable digestion, refining, and bleaching operations. In a preferred embodiment, the cellulosic fibers in the paper include from about 0% to about 40% by weight dry basis softwood fibers and from about 100% to about 60% by weight dry basis hardwood fibers. In certain embodiments, at least a portion of the fibers may be provided from non-woody herbaceous plants including, but not limited to, kenaf, hemp, jute, flax, sisal, or abaca although legal restrictions and other considerations may make the utilization of hemp and other fiber sources impractical or impossible. The paper may also include other conventional additives such as, for example, starch, mineral fillers, sizing agents, retention aids, and strengthening polymers. Among the fillers that may be used are organic and inorganic pigments such as, by way of example, polymeric particles such as polystyrene latexes and polymethylmethacrylate, and minerals such as calcium carbonate, kaolin, and talc. In some instance, the papers may also include hollow microspheres.

A variety of papers and paperboards may be provided by the invention having a wide variety of basis weights and formed from a wide variety of cellulosic fibers. These include but are not limited to, including office papers, forms papers, envelope papers, label stock, bristols, and printing and publication papers as well as bleached boards and linerboards.

Office papers formed according to the present invention preferably have a final caliper, after calendering of the paper, and any nipping or pressing such as may be associated with subsequent coating of from about 3.5 to about 10 mils. Office papers of the invention also preferably exhibit basis weights of from about 18 lb/1300 $ft^2$ to about 32 lb/1300 $ft^2$, Bleached boards formed according to the present invention preferably have a final caliper, after calendering of the board, and any nipping or pressing such as may be associated with subsequent coating of up to about 45 mils. Bleached boards of the invention also typically exhibit basis weights of from about 40 lb/1000 $ft^2$ to about 90 lb/1000 $ft^2$, Linerboards formed according to the present invention preferably have a final caliper, after calendering of the board, and any nipping or pressing such as may be associated with subsequent coating of up to about 45 mils. Linerboards of the invention also preferably exhibit basis weights of from about 25 lb/1000 $ft^2$ to about 100 lb/1000 $ft^2$.

Importantly, the papers of the present invention include a boron-containing compound in combination with starch. The boron-containing compound is preferably selected from the group consisting of boric acid and anhydrous and hydrated metal borate salts. Particularly preferred boron-containing compounds include anhydrous and hydrated sodium borate (Borax), potassium borate, boric oxide, boric acid, and zinc borate. The boron-containing compound is added in proportion to the amount of starch being added and the amount may also vary widely. In the preferred embodiments the amount of boron containing compound will depend on the amount of starch. In these preferred embodiments, the compound is present in an amount equal to or less than about 7% of the weight of starch added to the furnish, preferably equal to or less than about 5% of the weight of starch added to the furnish, more preferably equal to or less than about 3% of the weight of starch added to the furnish and most, preferably from about 0.2% to about 2% of the weight of starch added to the furnish. In the embodiments of choice, the amount of starch is from about 0.7% to about 0.8% of the weight of starch added to the furnish.

A starch solution is added to the paper in combination with the boron-containing compound. The starch solution may include a cationic starch, an anionic starch, an amphipathic starch, or a combination of more of more of these starches. Suitable starch sources include cornstarch, wheat starch, potato starch, rice starch, tapioca starch, and sago starch. The type and amount of starch added to the paper may vary depending on the particular embodiment of the invention as described in more detail herein below.

The addition of the starch and boron-containing compound to the paper may vary depending on the particular embodiment of the invention. In one embodiment of the invention, the starch and boron-containing compound are added to the furnish prior to the forming of the web on the papermaking machine. In another embodiment, the combination of starch and boron-containing compound are added at the size press after the web has been formed and at least partially dried. Papers according to the invention have been observed to have improved resistance to moisture expansion and shrinkage. That is the papers exhibit less fiber expansion when in a moist or humid environment than conventional papers and also exhibit less fiber shrinkage when in a particularly arid environment In some embodiments of the invention, the papers exhibit improvements in strength and stiffness properties including Gurley stiffness, modulus of elasticity, tensile energy absorption, and/or tensile strength.

The method of forming the paper materials of the present invention includes providing an initial paper furnish. The cellulosic fibrous component of the furnish is suitably of the chemically pulped variety, such as a bleached kraft pulp, although the invention is not believed to be limited to kraft pulps, and may also be used with good effect with other chemical pulps such as sulfite pulps, mechanical pulps such as ground wood pulps, and other pulp varieties and mixtures thereof such as chemical-mechanical and thermo-mechanical pulps.

While not essential to the invention, the pulp is preferably bleached to remove lignins and to achieve a desired pulp brightness according to one or more bleaching treatments known in the art including, for example, elemental chlorine-based bleaching sequences, chlorine dioxide-based bleaching sequences, chlorine-free bleaching sequences, elemental chlorine-free bleaching sequences, and combinations or variations of stages of any of the foregoing and other bleaching related sequences and stages.

After bleaching is completed and the pulp is washed and screened, it is generally subjected to one or more refining steps. Thereafter, the refined pulp is passed to a blend chest where it is mixed with various additives and fillers typically incorporated into a papermaking furnish as well as other pulps such as unbleached pulps and/or recycled or post-consumer pulps. The additives may include so-called internal sizing agents used primarily to increase the contact angle of polar liquids contacting the surface of the paper such as alkenyl succinic anhydride (ASA), alkyl ketene dimer (AKD), and rosin sizes. Retention aids may also be added at this stage, including both cationic and anionic retention aids.

An amount of internal starch is typically added to the paper furnish at this point as well. In one embodiment of the invention, the boron-containing compound is added in to the furnish in combination with this starch. In this embodiment, starch is typically added to the furnish in an amount as described above as for example an amount of about 3 lb of starch/ton of paper to about 30 lbs of starch/ton of paper. Also, boron-containing compound is typically added to the furnish in an amount based on the weight of the starch added to the furnish in an amount as described above.

In this embodiment, it is preferred that the boron-containing compound has a relatively high water solubility. It is preferred to pre-mix the converted (cooked) starch solution and the boron-containing compound with one another, thereby providing a slurry of starch and boron-containing compound and then add this slurry mixture to the furnish as a later step.

In this embodiment, the preferred boron-containing compound is boric acid. It is also preferred that the starch being added to the furnish is a cationic starch. The invention may employ a preconverted starch, that is, a starch which has been previously reacted with additives such as ammonium persulfate and/or conversion enzymes in order to partially convert the highly branched molecular structure of the raw starch into a structure which is somewhat more linear and less branched. However, if the starch has not been preconverted, then it may be cooked and converted in the slurry with the boron-containing compound at a temperature of about 95-100° C. and then cooled to about 40-60° C. prior to addition to the furnish.

In another embodiment of the invention, the boron-containing compound may be directly added to the furnish mixture, and separately, the starch solution may be directly added to the furnish. This is typically preferred if the boron-containing compound is one of relatively low aqueous solubility such as zinc borate for example.

Once prepared, the furnish is formed into a single or multiply web on a papermaking machine such as a Fourdrinier machine or any other suitable papermaking machine known in the art, as well as those which may become known in the future. The basic methodologies involved in making paper on various papermaking machine configurations are well known to those of ordinary skill in the art and accordingly will not be described in detail herein. In general, a furnish consisting of a relatively low consistency aqueous slurry of the pulp fibers (typically about 0.1 to about 1.0%) along with the microspheres and various additives and fillers dispersed therein is ejected from a headbox onto a porous endless moving forming sheet or wire where the liquid is gradually drained through small openings in the wire until a mat of pulp fibers and the other materials is formed on the wire. The still-wet mat or web is transferred from the wire to a wet press where more fiber-to-fiber consolidation occurs and the moisture is further decreased. The web is then passed to an initial dryer section to remove most of the retained moisture and further consolidate the fibers in the web. After initial drying, the web may be further treated using a size press wherein additional starch, pigments, and other additives may be applied to the web and incorporated therein by the action of the press.

In another embodiment of the invention, the boron-containing compound may also be added to the paper along with this starch addition in addition to, or in place of, addition of the boron-containing compound with the wet end internal starch. In this embodiment, starch is typically added at the size press in the desired amount as for example at a starch pickup rate of from about 40 to about 150 lbs starch/ton of paper and the boron-containing compound is typically added with the starch at the size press, in the desired amount and based on the weight of starch solids added as for example from about 0.2% to about 1.0% (preferably 0.7% to about 0.8%) by weight of the starch.

In this embodiment as well, it may be preferred that the starch and the boron-containing compound be pre-mixed into a slurry. In addition, if the starch is a raw, unconverted starch, such as a pearl starch, then it may be preferred to mix the raw starch and the boron-containing compound, and then cook the resultant slurry to convert the starch prior to application at the size press. The conversion may be aided by the use of additives such as ammonium persulfate and conversion enzymes. The conversion may be carried at a temperature of from about 100-105° C. After conversion, the starch is then maintained at about 60-70° C. until it is applied at the size press. For application at the size press, a preferred boron-containing compound is borax (sodium borate).

After treatment in the size press and subsequent drying, the paper is preferably calendered to achieve the desired final caliper as discussed above to improve the smoothness and other properties of the web. The calendering may be accomplished by steel-steel calendaring at nip pressures sufficient to provide a desired caliper. It will be appreciated that the ultimate caliper of the paper will be largely determined by the selection of the nip pressure.

As noted the resultant papers are observed to have improved resistance to hygroexpansion and to other detrimental effects of high humidity environments such as curling and cockling. Without being bound by theory, it is believed that the inclusion of the boron-containing compound achieves this affect by promoting formation of a complex between the starch molecules and the boron-containing compound. The complexing is believed to limit the penetration of the starch into the cellulosic fibers.

Penetration of the starch solids into the cellulosic fibers is believed to provide a route for moisture to penetrate into the fibers as well. Thus, starch addition typically makes the paper more susceptible to hygroexpansion and other dimensional instability when in a high humidity environment. However, by promoting complexing of starch molecules one with another, the amount of starch available to penetrate the cellulosic fibers is reduced. Accordingly the fibers are less susceptible to moisture penetration and exhibit less dimensional variation with changing environmental conditions.

Surprisingly, it has also been observed that in some embodiments the use of the boron-containing compounds leads to improvements in the strength and stiffness properties of the paper formed according to the invention. The papers may also exhibit improvements in Gurley stiffness, modulus of elasticity, tensile energy absorption, and/or tensile strength.

The following no limiting examples illustrate various additional aspects of the invention. Unless otherwise indicated, temperatures are in degrees Celsius, percentages are by weight and the percent of any pulp additive or moisture is based on the oven-dry weight of the pulp.

Example I

A series of hand sheet samples of a linerboard were produced to determine the effect of addition of a boron-containing compound, together with starch, in a pulp furnish. The board was formed from a pulp mixture of about 80% hardwoods and about 20% softwoods. The first (control) sample was formed without any internal starch or boron-containing compound.

Sample 2 was formed from the same furnish, except that starch was added to the furnish mixture at a ratio of about 20 lb starch/ton of pulp fibers prior to the furnish being formed into the hand sheets. Again, no boron-containing compound was included in the furnish.

In Sample 3, the pulp mixture was used and in this sample, the furnish was combined with about 20 lb starch/ton of pulp fibers and about 1% of boric acid, based on the weight of starch added. The starch and boric acid were initially combined with one another to form slurry. This slurry was cooked and then added to the furnish prior to hand sheet formation.

In Sample 4, zinc borate was added to the pulp mixture at a ratio of about 20 lb zinc borate/ton of pulp fibers. No internal starch was added to the pulp mixture.

In Sample 5, about 20 lb of starch/ton of pulp fibers and about 20 lb of zinc borate/ton of pulp fibers were added to the furnish. No boric acid was included with the starch. Finally, in Sample 6, about 20 lb of starch/ton of pulp fibers (with about 1% boric acid based on the weight of starch added) and about 20 lb of zinc borate/ton of pulp fibers were added to the furnish.

The physical and mechanical properties of each hand sheet sample were then measured. The results are listed in Table I.

TABLE I

| Property and Units | Sample 1 | Sample 2 | Sample 3 | Sample 4 | Sample 5 | Sample 6 |
|---|---|---|---|---|---|---|
| Air Resistance Gurley s/100 cc | 3.1 | 2.8 | 3.8 | 4.5 | 3.1 | 3.5 |
| Apparent Density g/cm$^3$ | 0.468 | 0.492 | 0.526 | 0.492 | 0.506 | 0.527 |
| Basis weight g/m$^2$ | 307 | 328 | 326 | 326 | 346 | 325 |
| Basis weight lb/1000 ft$^2$ | 62.9 | 67.1 | 66.7 | 66.7 | 70.6 | 66.5 |
| Bulk cm$^3$/g | 2.14 | 2.03 | 1.90 | 2.03 | 1.99 | 1.90 |
| Burst factor gf/cm$^2$/g/m$^2$ | 20.2 | 23.8 | 25.7 | 23.6 | 24.5 | 24.9 |
| Burst lbf/in$^2$ | 88.1 | 111 | 119 | 109 | 120 | 115 |
| Caliper mil | 25.86 | 26.11 | 24.31 | 26.18 | 26.48 | 24.35 |
| Instron Breaking Length m | 2940 | 3410 | 3290 | 3430 | 3180 | 3250 |
| Instron Stretch at Peak % | 2.18 | 2.65 | 2.84 | 2.76 | 2.74 | 2.74 |
| Instron TEA at peak in * lbf/in$^2$ | 0.825 | 1.21 | 1.26 | 1.20 | 1.16 | 1.16 |
| Instron tensile strength lbf/in | 50.5 | 62.7 | 60.1 | 62.6 | 61.5 | 59.2 |
| Instron Young's Modulus of Elasticity. 1E + 3 lbf/in$^2$ | 159 | 186 | 176 | 188 | 179 | 190 |
| Internal Bond 1E − 3 ft * lb/in$^2$ | 56 | 65 | 100 | 80 | 109 | 93 |
| Compressive strength, lbf/in | 26.32 | 31.46 | 32.06 | 31.79 | 35.15 | 30.38 |
| Stiffness Gurley mgf | 8010 | 9930 | 8840 | 10000 | 12600 | 9500 |
| Tear Factor 100 gf/g/m$^2$ | 171 | 181 | 198 | 176 | 193 | 169 |
| Tear gf | 524 | 592 | 646 | 572 | 668 | 550 |
| Z-direction direction tensile strength lbf/in$^2$ | 26 | 30 | 35 | 33 | 37 | 42 |

Example II

A series of hand sheet samples of an offset printing paper were produced to determine the effect of addition of a boron-containing compound, together with starch, in the sizing of a paper at the size press. The board was formed from a pulp mixture of about 80% hardwoods and about 20% softwoods. The first (control) sample was formed as a control. This sheet was not treated with either starch or boron-containing compound at the size press. In Sample 2, a base sheet formed in accordance with Sample 1 was sized by applying a 16% starch solids mixture with a rod-metering device and sizing the sheet using a Beloit size press. No boron-containing compound was included with the sizing starch. The starch was a Staley Pearl AP starch that was converted using ammonium persulfate. The starch was applied at a pickup rate of about 100 lb/ton of base sheet.

In Sample 3, the sheet was formed and sized as in Sample 2, except that the starch solids were applied at 10% solids rather than 16% solids. Again, no boron-containing compound was included with the sizing starch.

In Sample 4, a base sheet formed in accordance with Sample 1 was sized by applying a mixture comprising 16% starch solids and borax (sodium borate pentahydrate). The ratio (by weight) of the borax in the mixture to the starch solids was about 0.25%. Prior to being applied to the sheet, the mixture of starch and borax was cooked with of ammonium persulphate in order to convert the starch. The mixture was applied with a rod-metering device, and the sheet was sized using a Beloit size press.

In Sample 5, the sizing was carried out in accordance with Sample 4, except that the weight ratio of borax to starch solids was 0.50% rather than 0.25%.

In Sample 6, the starch was applied at a 10% starch solids concentration in the mixture. Borax was added in a ration of 0.50% borax to starch solids by weight. Finally, the pickup rate of the rod-metering device was lowered from 100 lb/ton to 60 lb/ton.

The physical and mechanical properties of each hand sheet sample were then measured. The results are listed in Table II.

TABLE II

| Property and Units | Sample 1 | Sample 2 | Sample 3 | Sample 4 | Sample 5 | Sample 6 |
|---|---|---|---|---|---|---|
| Hygroexpansion from 15% to 85% rel. humidity | 0.87% | 1.05% | 1.08% | | 0.85% | 1.10% |
| Air Resistance Gurley s/100 cc | 9.5 | 11.8 | 11.6 | 12.5 | 10.6 | 11.3 |
| Apparent Density g/cm$^3$ | 0.620 | 0.623 | 0.618 | 0.620 | 0.626 | 0.623 |
| Basis Weight g/m$^2$ | 69.7 | 70.4 | 70.0 | 71.0 | 71.1 | 70.7 |
| Basis Weight lb/1300 ft$^2$ | 18.5 | 18.7 | 18.6 | 18.9 | 18.9 | 18.8 |
| Basis Weight lb/3300 ft$^2$ | 47.1 | 47.6 | 47.3 | 48.0 | 48.0 | 47.8 |
| Brightness Directional (GE), % FS | 84.2 | 83.4 | 83.5 | 83.0 | 83.3 | 83.6 |
| Brightness Directional (GE), % WS | 84.2 | 83.8 | 83.8 | 83.6 | 83.7 | 83.7 |
| Bulk ASV cm$^3$/g | 1.61 | 1.61 | 1.62 | 1.61 | 1.60 | 1.61 |

TABLE II-continued

| Property and Units | Sample 1 | Sample 2 | Sample 3 | Sample 4 | Sample 5 | Sample 6 |
|---|---|---|---|---|---|---|
| Caliper? mil | 4.43 | 4.46 | 4.46 | 4.52 | 4.47 | 4.48 |
| COF Kinetic | 0.353 | 0.306 | 0.304 | 0.312 | 0.258 | 0.266 |
| COF Static | 0.456 | 0.440 | 0.415 | 0.471 | 0.396 | 0.444 |
| Dry Pick IGT, VVP FS | 27.0 | 53.2 | 47.8 | 60.8 | 51.6 | 47.7 |
| Dry Pick IGT, VVP WS | 36.3 | 35.7 | 40.2 | 40.1 | 35.8 | 37.4 |
| Instron stretch at peak, % (MD) | 1.56 | 1.76 | 1.68 | 1.65 | 1.65 | 1.58 |
| Instron stretch at peak, % (CD) | 3.28 | 4.14 | 3.77 | 3.83 | 3.26 | 3.90 |
| Instron TEA at peak in * lbf/in$^2$ (MD) | 0.161 | 0.216 | 0.210 | 0.194 | 0.205 | 0.197 |
| Instron TEA at peak in * lbf/in$^2$ (CD) | 0.219 | 0.290 | 0.259 | 0.302 | 0.227 | 0.259 |
| Instron Tensile Strength MD/CD Ratio | 2.01 | 2.21 | 2.35 | 1.92 | 2.19 | 2.35 |
| Instron tensile strength lbf/in (MD) | 18.0 | 19.9 | 19.8 | 19.8 | 20.4 | 20.5 |
| Instron tensile strength lbf/in (CD) | 8.94 | 9.01 | 8.44 | 10.3 | 9.32 | 8.74 |
| Instron Young's Modulus. of Elasticity 1E + 3 lbf/in$^2$ (MD) | 469 | 506 | 524 | 515 | 533 | 547 |
| Instron Young's Modulus of Elasticity 1E + 3 lbf/in$^2$ (CD) | 209 | 200 | 190 | 228 | 209 | 185 |
| Instron Internal Bond, 1E − 3 ft * lb/in$^2$ (MD) | 118 | 127 | 126 | 126 | 116 | 118 |
| Instron Internal Bond, 1E − 3 ft * lb/in$^2$ (CD) | 114 | 127 | 124 | 131 | 113 | 116 |
| Opacity Tappi, % (89% backing) | 89.1 | 98.8 | 88.9 | 89.0 | 89.2 | 89.0 |
| Pick Velocity m/s FS | 3.00 | 3.00 | 3.00 | 3.00 | 3.00 | 3.00 |
| Pick Velocity m/s WS | 3.00 | 3.00 | 3.00 | 3.00 | 3.00 | 3.00 |
| Roughness Parker, um 10 kgf/cm$^2$ softback FS | 7.49 | 7.96 | 7.75 | 8.40 | 7.96 | 7.93 |
| Roughness Parker, um 10 kgf/cm$^2$ softback WS | 9.73 | 10.07 | 10.00 | 9.72 | 9.68 | 9.96 |
| Roughness Sheffield FS | 258 | 263 | 270 | 270 | 266 | 281 |
| Roughness Sheffield WS | 302 | 323 | 320 | 320 | 313 | 329 |
| Size Hercules, sec (1% ink, 80% endpt) FS | 1 | 33 | 26 | 40 | 49 | 33 |
| Size Hercules, sec (1% ink, 80% endpoint) WS | 1 | 14 | 18 | 21 | 21 | 19 |
| Stiffness Gurley, mgf (MD) | 123 | 130 | 149 | 154 | 148 | 146 |
| Stiffness Gurley, mgf (CD) | 48.4 | 62.5 | 67.9 | 81.7 | 70.6 | 65.3 |
| Tear factor 100 gf/g/m$^2$ (MD) | 15.8 | 15.6 | 15.7 | 14.1 | 15.5 | 15.6 |
| Tear factor 100 gf/g/m$^2$ (CD) | 17.2 | 17.0 | 15.7 | 16.9 | 18.3 | 17.0 |
| Tear gf (MD) | 55.7 | 53.8 | 53.8 | 51.8 | 53.8 | 55.4 |
| Tear gf (CD) | 57.6 | 58.2 | 56.6 | 61.4 | 60.2 | 57.0 |
| Wax pick, critical wax strength no. FS | 7 | 11 | 10 | 14 | 11 | 11 |
| Wax pick, critical wax strength no. WS | 11 | 10 | 10 | 10 | 10 | 10 |
| Z-direction tensile strength lbf/in$^2$ | 97 | 106 | 107 | 112 | 105 | 110 |

Having now described various aspects of the invention and preferred embodiments thereof, it will be recognized by those of ordinary skill that numerous modifications, variations and substitutions may exist within the spirit and scope of the appended claims.

What is claimed is:

1. A paper or paperboard, comprising cellulosic fibers, and a sizing or coating composition comprising starch; and a boron-containing compound, wherein the amount of boron-containing compound is equal to or less than about 7% by weight of the starch; and greater than 50% of the starch and boron-containing compound is located at least one surface of the web;

and wherein at least a portion of the starch and boron-containing compound penetrates the surface of the web.

2. The paper or paperboard of claim 1 wherein the amount of starch is equal to or less than about 200 lbs per ton of fiber.

3. The paper or paperboard of claim 1 wherein the boron-containing compound is selected from the group consisting of boric acid and borate metal salts.

4. The paper or paperboard of claim 1, wherein the boron-containing compound is selected from the group consisting of boric acid, borax, and zinc borate.

5. The paper or paperboard of claim 1 wherein the boron-containing compound and the starch form a complex.

6. The paper or paperboard according to claim 1, wherein the amount of boron-containing compound is from about 0.2% to about 7% by weight of the starch.

7. The paper or paperboard according to claim 1, wherein the amount of boron-containing compound is less than 5% by weight of the starch.

8. The paper or paperboard according to claim 1, wherein the amount of boron-containing compound is from about 0.2 to less than 5% by weight of the starch.

9. The paper or paperboard according to claim 1, further comprising hollow microspheres.

10. The paper or paperboard according to claim 1, wherein the paper or paperboard is at least one member selected from the group consisting of office paper, form paper, envelope paper, label stock paper, bristol paper, printing paper, publication paper, bleached board, and linerboard.

11. The paper or paperboard of claim 1 wherein the starch is selected from the group consisting of corn starch, wheat starch, potato starch, rice starch, tapioca starch, and sago starch.

12. The paper or paperboard of claim 1 wherein the starch is selected from the group consisting of anionic starch, cationic starch and amphipathic starch.

13. A method for making the paper or paperboard according to claim 1, comprising:

providing a papermaking furnish comprising cellulosic fibers;

forming a fibrous web from the papermaking furnish;

drying the web; and sizing or coating the web with the composition to form a sized or coated web.

14. The method of claim 13 further comprising calendering the sized or coated web to provide a finished paper or paperboard.

15. The method according to claim 13, wherein the papermaking furnish further comprises hollow microspheres.

16. The method according to claim 13, wherein the amount of boron-containing compound is from about 0.2% to about 7% by weight of the starch.

17. The method according to claim 13, wherein the amount of boron-containing compound is less than 5% by weight of the starch.

18. The method according to claim 13, wherein the amount of boron-containing compound is from about 0.2 to less than 5% by weight of the starch.

* * * * *